US006916054B1

(12) United States Patent
Baldesberger

(10) Patent No.: US 6,916,054 B1
(45) Date of Patent: Jul. 12, 2005

(54) TWEEZERS

(75) Inventor: Fides P. Baldesberger, Lugano (CH)

(73) Assignee: Outils Rubis SA, (CH)

( * ) Notice: Subject to any disclaimer, the term of this patent is extended or adjusted under 35 U.S.C. 154(b) by 97 days.

(21) Appl. No.: 10/049,289

(22) PCT Filed: Aug. 18, 2000

(86) PCT No.: PCT/CH00/00441

§ 371 (c)(1),
(2), (4) Date: Feb. 11, 2002

(87) PCT Pub. No.: WO01/13756

PCT Pub. Date: Mar. 1, 2001

(30) Foreign Application Priority Data

Aug. 20, 1999 (EP) ..... 99810749

(51) Int. Cl.[7] ..... B25B 9/02
(52) U.S. Cl. ..... 294/99.2
(58) Field of Search ..... 294/3, 8.5, 16, 294/33, 99.2

(56) References Cited

U.S. PATENT DOCUMENTS 533,923 A * 2/1895 Seyfriedt ..... 29/232
1,889,475 A * 11/1932 Henkel ..... 294/99.2
3,115,360 A 12/1963 Witkoff ..... 294/99
4,318,313 A 3/1982 Tartaglia ..... 81/43
4,387,610 A * 6/1983 Sergeant ..... 81/342
D272,479 S * 1/1984 Van Roeyen et al. ..... D28/55
5,192,106 A 3/1993 Kaufman ..... 294/99.2
5,263,968 A * 11/1993 Sorensen ..... 606/207

FOREIGN PATENT DOCUMENTS

DE 28 22 706 11/1978
DE 295 12 216 U1 12/1995
DE 198 11 033 C1 8/1999
GB 2035187 * 6/1980 ..... 294/99.2
JP 1-257571 * 10/1989 ..... 294/99.2

* cited by examiner

*Primary Examiner*—Dean J. Kramer
(74) *Attorney, Agent, or Firm*—Blank Rome LLP

(57) ABSTRACT

The invention relates to tweezers made of light weight metal (10) and having two pincers (12, 14) each of which forms a head part (13) on one of their ends and can be reversibly and temporarily brought together on their other end by manually applying a closing pressure; the tweezers (10) preferably consist of extruded light weight metal and are embodied as a single pierce. A closed novel extrusion profile (60) with an approximately tweezers-shaped cross-section is preferably used in the production of the tweezers.

15 Claims, 2 Drawing Sheets

TWEEZERS

Figure 1:
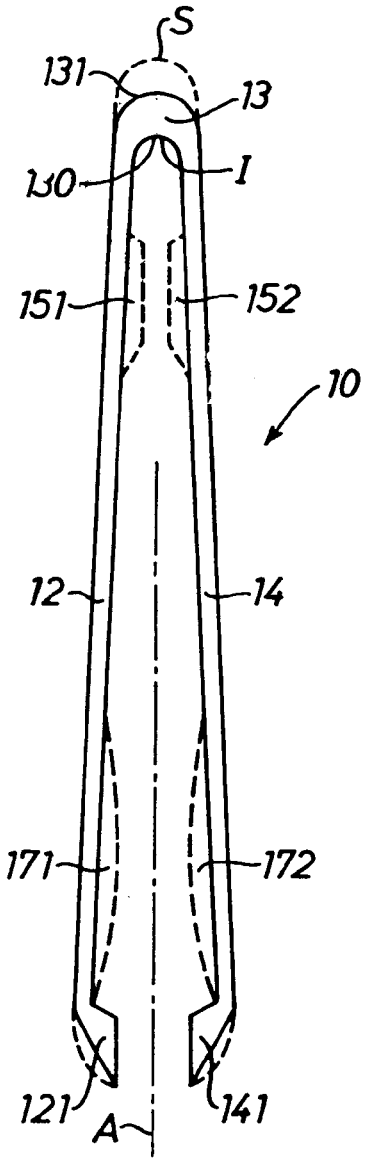

This is a National Phase patent application based on PCT/CH00/00441 filed 18 Aug. 2000 which in turn is based on EP Application No. 99810749.4 filed 20 Aug. 1999, the priority being claimed.

BACKGROUND OF THE INVENTION

The invention concerns a pincette which, in a manner known per se, has two legs connected at one of their ends with each other, and which ends can be brought in temporary engagement with each other at their other ends by impact of a manually effected closure pressure.

Pincettes of this type have been known for a long time and in many embodiments, such as disclosed, for example, in DE GM 85 31 382, CH 376 064, and EP 0 849 048. Essentially, such pincettes consist of two legs, generally made of steel, interconnected at one of their ends by welding, soldering, or riveting.

As described in DE 28 22 706 in more detail, the force required to close the pincette, i.e. the minimal manual closure pressure, must be sufficient to assure a good gripping of the pincette but must not be so high that operation leads to fatigue. In other words, the pincette must be neither too "soft" nor too "hard". In order to replace conventional forged and, thus, expensive pincettes by disposable pincettes, as disclosed in the entire document just mentioned, the pincette proposed therein is made of thin sheet-metal from which profiled pincette legs are formed and connected, e.g. by spot welding. This indicates that the fine sheet-metal must consist of a material, such as steel, which is capable of being processed in this manner.

For reasons of weight and costs it would be desirable that such pincettes would consist of a light-metal yet have the essential mechanical properties of known forged pincettes and could be produced in a simple and economic manner.

Therefore, a first object of the invention is to provide a pincette made of a light-metal having the same essential mechanical properties as forged pincettes. A second object is to provide a method for economical manufacture of such light-metal pincettes.

U.S. Pat. No. 5,192,106 discloses tongs made of spring-steel, plastics, aluminum, copper, brass, or a composite material for handling compact disks (CDs) capable of gripping a CD both at its outer edge as well as at the edge of a central opening. For both types of function, the legs will not be closed as it would be the case with a pincette. Tongs of this type, by necessity, differ from pincettes, both with regard to mechanical properties as well as to shape.

DE 198 11 033 discloses a multi-component tubular shaft-tongs tool for surgical purposes wherein the pull- and push-rods, the operating handles, the shaft and the jaw-type working tool consist of aluminum or aluminum-alloy and are coated with aluminum nitride.

To the best of the applicant's knowledge, the state of the art does not comprise a teaching indicating in which manner a usable light-metal pincette, i.e. one having the essential mechanical properties, should be made-up, or how it could be manufactured in an economical manner.

Applicant's research leading to the present invention has shown that this aim cannot be achieved by a simple exchange of material because the connection of pincette legs made of a light-metal by riveting, welding, or gluing is problematic, yields an unsightly connecting site, requires expensive processing (inert-gas welding), or will not have sufficient strength, nor be sufficiently temperature-resistant, respectively.

Also, the "monolithic" structure of pincettes made of steel disclosed in DE 295 12 216 by bending deformation is not suitable for pincettes made of a light-metal because of the characteristics of these materials, and the structure is not monolithic because of the milled-in spring element.

The invention, in a first embodiment, concerns a pincette of the type defined in the introductory paragraph, i.e. having two legs interconnected at one of their ends and capable of being brought into temporary and reversible contact at the other end by impact of a manual closure pressure, and is characterized in that the pincette essentially consists of a preferably extruded light-metal and is structured monolithically.

The term "monolithic" used here in the context of pincettes indicates that the light-metal of both legs is entirely homogenous even in their common apex area, that is, being connected neither mechanically nor by welding, much less by soldering or gluing. In other words, the pincette according to the invention consists of one integral work piece (i.e. unlike forged pincettes of two interconnected pieces) and normally does not have additional functional members. Thus, use of additional spring elements is to be excluded, notably since the resilient elasticity of a pincette according to the invention is quite sufficient per se.

"Essentially consisting of a light-metal" indicates herein that all essential parts of the pincette consist of a light-metal. Nevertheless, this does not preclude use of a coating varnish, decorations, plastic coatings or laminates, e.g. for electric insulation or the like.

It was found that the closure pressure of a pincette according to the invention should, in general, be at least about 120 g, preferably at least about 150 g, and typically at least about 200 g. For reasons of simplicity, the closure pressure indicates the minimum manual pressure that has to be applied to a pincette, in its state at rest, just for achieving mutual contact of the "lower" or "distal" ends but without any additional pressure for grasping an object. The "upper" or "proximal" end of the legs herein refers to the apex area forming the transition of legs while the "lower" or "distal" end of the legs refers to the opposite end. The closure pressure is also an indication of the resilient elasticity, or resilient capacity, of the legs of the pincette, and should not, under normal conditions and upon an essentially indefinite period of use, change significantly.

The qualification of numeric values by "about", here and below, is intended to refer to an admissible deviation by ±15% from the stated value.

The closure pressure can be measured in a rather simple manner with an accuracy sufficient for the invention, e.g. on a letter-balance by observing the difference value between the dead weight of the pincette and the weight indicated when the distal ends of the legs of the pincette just get into contact with each other.

When normally, i.e. manually, actuating a pincette, the manually exerted pressure for grasping an object usually is a multiple of the closure pressure. Consequently, it is essential for normal functioning of a pincette according to the invention that it will not be deformed permanently by any normally effected manual pressure, i.e. without the use of tools.

Quantitatively expressed, this means that no permanent deformation of the pincette will be observed at a manual pressure that is a multiple of typically at least 10-times the closure pressure.

It was found that both the closure pressure as well as the maximum pressure, that does not result in a permanent deformation, of pincettes made of a light-metal or a light-metal alloy according to the invention can be controlled by a relatively small local increase of thickness of the material.

This would require a considerable technological effort which—according to a second object of the invention—can be avoided by using the method according to the invention.

This method for producing a monolithic light-metal pincette constitutes a further embodiment of the invention and is characterized by providing an extruded light-metal profile having a cross-sectional shape which approaches that of the pincette to be produced, and dividing into pieces the profile at least approximately transverse to its longitudinal (or axial) direction to obtain a plurality of pincettes or "green" pincettes, respectively.

The definition "at least approximately transverse to the longitudinal extension" is intended to include a deviation of up to 15 degrees (corresponding to a cutting angle of up to 75 degrees, or a deviation of ⅙, respectively).

According to a preferred embodiment, a closed profile is used to this end. It can be divided slantwise at its lower end prior or subsequent to division into pieces so as to form claws.

An extruded light-metal profile, having the shape at least approaching the shape of a pincette, constitutes another embodiment of the invention. Preferably, such a profile is provided as a closed profile, i.e. it defines, in a radial direction, a closed space. "Radial", in this context, indicates a direction perpendicular to the axial or longitudinal direction (e.g. the direction of pressure-extrusion of the profile) of the extruded profile. In contrast, the longitudinal direction of a pincette according to the invention extends from its upper to its lower end.

The term "extruded profile" is understood to designate a semi-finished product having a defined cross-sectional profile and any desired length, as it can be obtained by extrusion under pressure or tension. The extruded profile according to the invention consists essentially of a light-metal composition known, or expected to be suitable, for production of extruded profiles by those experienced in the art.

It is to be noted, that use of an extruded profile material as a semi-finished product for production of pincettes according to the invention is preferred primarily for economic reasons; as a matter principle, both an individual production of a pincette according to the invention, as well as production of extruded profile materials by other means than extrusion under pressure or tension appear possible.

Thanks to the properties of light-metals, such profiles according to the invention can be made by various shaping techniques, such as by drawing or pressing. As a matter of principle—yet under normally prohibitive production costs—light-metal pincettes according to the invention could also be produced individually, e.g. by molding, forging, or other techniques for individual production so that manufacture from light-metal profiles is preferred for economic reasons, but is not absolutely critical from a functional point of view, as long as the properties of the metal structure obtained are consistent with those of a profile shaped by extrusion under pressure or tension.

Achieving a solution of the aim of the invention, namely to provide light-metal pincettes having most advantageous properties, and to find a technologically favorable method of producing such pincettes, was surprising and was not, in any way, obvious from prior art.

Production of pincettes according to the invention can be simplified in a nearly dramatic manner. While, prior to the invention, production of pincettes with the essential properties of forged pincettes needed numerous production steps so as to substantially preclude automated production methods, production is reduced to providing a single semi-finished product, i.e. the extruded profile according to the invention, and division thereof into a plurality of pincettes. Both steps can be achieved in a completely automated manner when using a closed profile material, as will be explained in detail below.

However, this does not preclude a finishing step, e.g. for producing specific shapes at the lower ends of the legs and/or for surface finishing by mechanical, physical, or chemical, including electrochemical, processes.

As mentioned briefly above, pincettes according to the invention, according to a preferred embodiment for the control of essential mechanical properties of the pincette (i.e. a sufficiently high closure pressure and a high resistance against permanent deformation), have an increased gauge or bulge in the apex area and/or near the lower ends of the legs.

In this context, "bulge" is understood to refer to a local increase of normal thickness of the pincette legs. Typically, such bulges have a thickness which is greater at least by 20% than the normal thickness of the legs. "Normal" thickness of the legs, in other words, is the referenced thickness in the predominant part of the legs between the pincette points (working end) and the pincette end (connection of the legs). As a rule, the bulge of the legs is limited to a maximum of about a third (33%) of the whole pincette length, and is near the end of the pincette.

The legs of a pincette according to the invention can be shaped, at their lower ends which can be brought into mutual contact, in a manner known per se, as claws and/or pointed ends. Generally, the cross-section of the legs between their ends has a prismatic and, preferably, an essentially rectangular shape, the height of which corresponds to the normal thickness of the legs while the width thereof is at least twice as great as the normal thickness.

As already mentioned briefly, the apex area according to a preferred embodiment, has a thickness increased by at least about 20%, and is frequently provided on the inner side as a rounded surface. As explained below, this is not critical, if the grain structure, especially crystallinity, of the light-metal used insures a sufficient closure pressure, even without a bulge. Frequently, an optional bulge of the legs is positioned at the lowest third of the legs, i.e. near the gripping ends in the region of the pressure impact resulting from normal manual operation. According to a preferred embodiment, a bulge of the legs is dimensioned such that—upon impact of a manual pressure that could lead to permanent deformation—they will contact each other. In this manner, resistance against deformation can be increased into an area of forces well beyond those that could be achieved manually and would cause cold deformation of the light-metal.

Figure 4:
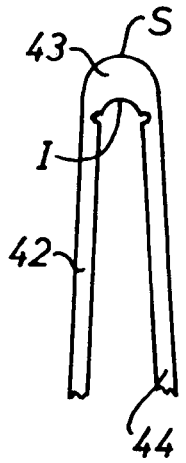
Figure 5:
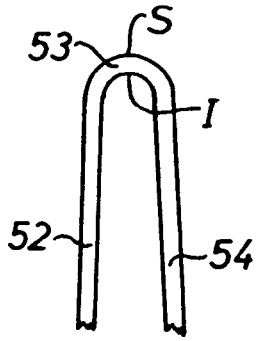
Figure 6:
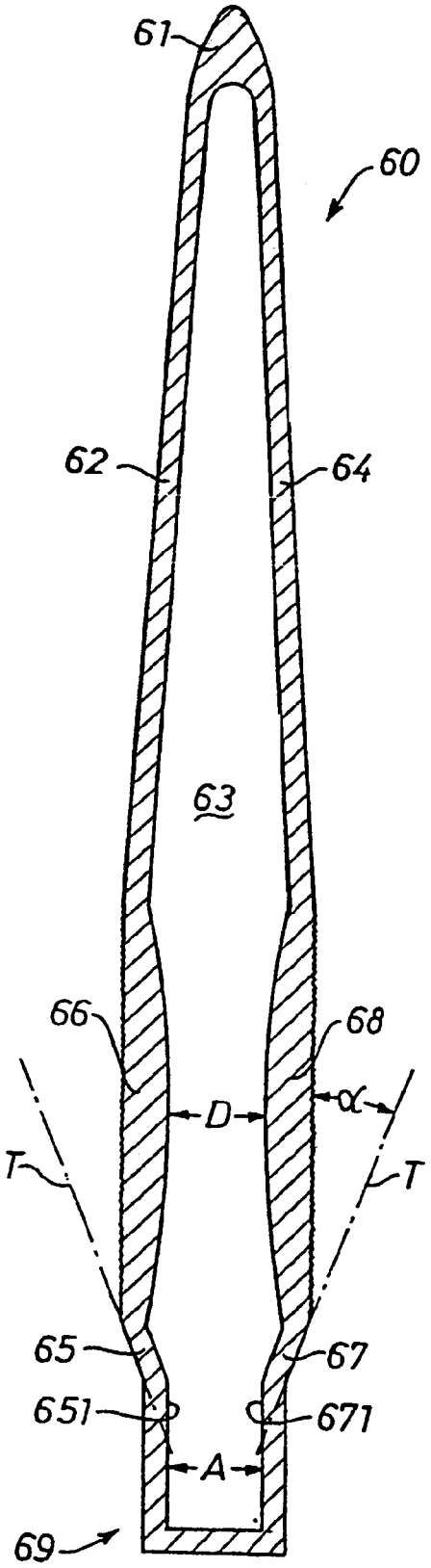

Preferred but not limiting embodiments of pincettes according to the invention will now be explained by way of the drawings, in which FIG. 1 is a side view of a pincette according to the invention, or of a light-metal profile from which it is produced, respectively, and FIGS. 2–5 are fragmented representations of some examples of modifications of the apex area of pincettes according to the invention, and FIG. 6 is an example of a preferred extruded profile according to the invention.

Specifically, FIG. 1 shows a semi-diagrammatic side view of pincette 10 and of the light-metal profile, respectively, from which the pincette has been produced by cutting or dividing, respectively, the profile, at least substantially vertical to the longitudinal extension of the profile, to form a sequence of profile pieces, preferably all having substantially the same width.

Legs 12, 14 extend from their ends 121, 141, shaped in the manner of claws, to apex area 13, where they are connected integrally and continuously. Apex area 13 can be shaped as a bulge in that its thickness at a cross-section along the longitudinal axis of pincette 10 through apex S is at least 20% greater than the thickness of legs 12, 14 in apex 13 at their transition. According to a preferred embodiment, the inner face of apex area 13 indicated as 130 is shaped as an arch or semi-circular shape, respectively. The shape of the outer face can be similar or different as long as the apex, in apex area 13, has a sufficient thickness. It is to be understood that ends 121, 141 can have any other required shape, e.g. forming slanted, pointed or point-slanted ends, but this aspect is not considered essential for the invention.

Near their claw-shaped ends 121, 141, or near apex area 13, legs 12,14 can be provided with bulges 171, 172 and 151, 152, respectively, so as to limit deformation of pincette 10 upon impact of an excessive manual closure pressure and achieving a practically unlimited resistance against permanent deformation.

Figure 2:
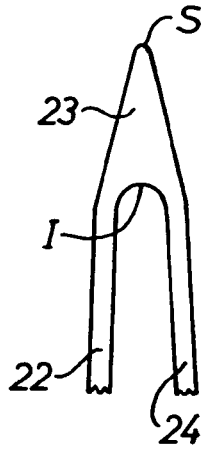
Figure 3:
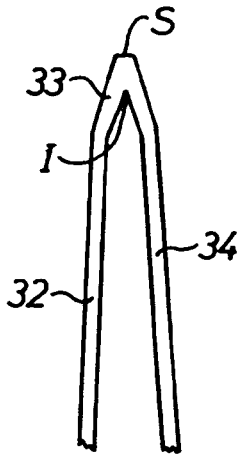

Legs 22, 24, according to FIG. 2, continue monolithically from one into the other in apex area 23 forming an acute angle at apex S while inner surface I is arch-shaped or substantially semi-circular. This, again, is a preferred but not a critical condition because a pincette according to the invention could also be shaped as shown in FIG. 3 where legs 32, 34 continue from one to the other in apex area 33 where both apex point S as well as inner surface I are shaped to form an acute angle.

The embodiment of the apex area 43 shown in FIG. 4 represents a further example of a pincette according to the invention where legs 42, 44 continue integrally in apex area 43 and are provided with recesses at the transition to the inner surface, which recesses can be used to control the desired closure pressure of a pincette according to the invention.

The generally arch-shaped embodiment of apex area 53 illustrated in FIG. 5 is shown to have no increased thickness at the transition of legs 52, 54 for reasons of explanation. Such an embodiment is usually not preferred and should (in a manner not shown) be protected against deformation of the pincette by a bulge near the lower end of the legs. Such a shape of the upper end of the pincette requires an extruded light-metal profile, i.e. must not be formed by bending since that would normally lead to a significant weakening of the grain structure. In contrast, an extruded profile has a homogeneous grain structure. On the other hand, a suitable extrusion method may lead to an increased strength of the grain structure.

FIG. 6 shows a cross-section of an extruded profile 60 with an increased thickness of up to about 300% (thickness-increase factor 3) at the upper end 61 and with two legs 62, 64 having an increased thickness near lower ends 65, 67 of up to about 200% (thickness-increase factor 2). The longitudinal (or axial) extension of extruded profile 60 extends perpendicular to the plane of drawing while the transverse (or radial) direction extends in the drawing plane.

Extruded profile 60 is a closed profile, i.e. it includes a space 63 closed all around. For production of finished pincettes, therefore, lower profile end 69 is closed and requires separation not only by transverse division (radial plain of division) into a plurality of pincettes, or green pincettes, respectively, but also requires separation in axial direction.

The closed extruded profile 60 presented in FIG. 6 is so shaped at its lower end 69 that division along a plane of division as indicated by dash-dot lines T and extending in axial direction, not only opens the closed profile but, at the same time, forms a suitable shape of the lower pincette ends 65, 67 which are normally distanced ("opened") by distance A, and have gripping areas 651, 671. Upon manual actuation ("closure") of a pincette according to the invention made from profile 60 by transversal or longitudinal division, a wedge-shaped inter-space remains which, upon reaching closing pressure, is initially closed but at its lower end, and will be closed progressively only upon an increasing manual pressure. This is a known feature of conventional pincettes having a claw-shaped end for achieving a good grip-and-hold-effect for an object, e.g. a hair, engaged by the pincette. In conventionally forged pincettes this requires a relatively time-consuming grinding operation executed by skilled personnel while, according to the invention, a simple separation step is sufficient to achieve this.

When using extruded profile 60 of FIG. 6, angle $\alpha$ of the plane of division indicated by lines T is about 20° degrees but can be varied between wide limits, e.g. between 10° and 80°. An angle range between 15 and 30° is preferred for many purposes.

According to a preferred embodiment, distance D between bulges 66, 68 in the lower third of the legs equals distance A at the lower end 69 of profile 60, and, consequently, is substantially equal to the distance between gripping areas 651, 671 of a pincette produced from the profile 60 when at rest, i.e. both gripping areas are distanced from each other by distance A. Permanent deformation of the pincette upon normal use can essentially be precluded in this manner. A typical pincette made from a profile of the type shown in FIG. 6 has a total length of about 90 mm, a leg thickness of about 2 mm, a leg width of about 6 mm, a closure pressure of about 200 g and a weight of 2.5 g. A general area of dimensions is between half and twice the values just mentioned. A conventionally forged pincette with comparable dimensions has a weight of at least about 6 g, typically about 8–9 g.

Suitable methods for a segmenting division of extruded profiles of a light-metal in axial and radial planes when carrying out the process according to the invention are well-known to those experienced in the art. Non-limiting examples of segmenting division techniques are mechanical separation by cutting or sawing as well the use of laser beams.

Within the context of the invention, metals of typical densities of less then about 4 g/ml are understood to be "light-metals", such as notably aluminum or magnesium, as well as alloys of such light-metals with each other and/or with other alloying constituents. The exact composition is not essential in so far as those experienced in the art of production of extruded profiles, notably by extrusion under pressure and/or tension, know the required compositions, or are capable of determination thereof in a simple manner. Commercially available alloys consisting predominantly of Al and/or Mg and generally containing Si and optional other alloying components can be mentioned by way of example. Examples of such alloys are light-metal alloys as defined in German Industrial Standards DIN 1748 under the type designations F11, F21, F28, F31, etc., as well as alloys obtainable under the trademarks Avional and Perunal. Light-metal alloys which can be electrically oxidized at their surfaces by conventional techniques ("Eloxal-processes") are preferred for many purposes.

When compared to conventional forged pincettes made of steel, advantages of light-metal pincettes according to the invention include not only a reduced density and mass as well as an essentially simplified production process using extruded profile material, but also in that surface design of articles made of a light-metal, notably aluminum or aluminum alloys, can be modified in many ways by oxidation techniques feasible therewith, both with regard to coloration possibilities, as well as surface properties (e.g. owing to the hardness of aluminum oxide).

In general, the invention provides a pincette essentially made of a light-metal, predominantly aluminum or aluminum alloys capable of extrusion, and having one pair of ends and an apex area at the other end for reversible mutual contact by impact of a manual closure pressure. Preferably, the pincette consists of an extruded light-metal, has a monolithic structure, and provides the essential mechanical properties of forged pincettes, namely a sufficiently high closure pressure, a good grip-and-hold-effect for objects that can be engaged by a pincette, and a practically any desired resistance against deformation upon normal use. For pincette manufacture, a preferably closed extruded profile with an approximately pincette-shaped cross-section is used so as to provide for a greatly simplified production.

To those experienced in the art, numerous modifications will be apparent within the scope of the invention. This applies, for example, to various forms of the gripping ends of the pincettes, and the dimensions of length and width that can be adapted on the basis of the above description. The scope of the invention results from the following claims.

What is claimed is:

1. A tweezer having a longitudinal dimension and comprising first and second legs extending along said longitudinal dimension, each leg having a first end and an opposite second end, the first ends of the legs being connected with each other forming an apex area, the second ends of the legs being unconnected and capable of reversible engagement with each other upon a manually exerted closure pressure; wherein said tweezers are formed of a light metal profile by extrusion and by separation of said profile approximately transversely to said direction of extrusion of said profile, said tweezer having an essentially monolithic structure.

2. The tweezer of claim 1, wherein said closure pressure is at least about 120 g.

3. The tweezer of claim 2, wherein each of said first and second legs, when viewed in a plane extending transversely to said extrusion direction of said profile, has a first thickness; and wherein said apex area, when measured in said plane along said longitudinal dimension, has a thickness that is increased by at least about 20% above said first thickness of each of said legs.

4. The tweezer of claim 3, wherein each of said first and second legs, when viewed in a plane transverse to said longitudinal dimension of said tweezer, has an essentially prismatic cross-section, the height of which corresponds to said first thickness of said legs, and the width of which cross-section is at least twice as large as said first thickness.

5. The tweezer of claim 2, wherein each of said first and second legs, when viewed in a plane transverse to said longitudinal dimension of said tweezer, has an essentially prismatic cross-section, the height of which corresponds to a first thickness of said legs, and the width of which cross-section is at least twice as large as said first thickness.

6. The tweezer of claim 1, wherein said closure pressure is at least about 150 g.

7. The tweezer of claim 1, wherein each of said first and second legs, when viewed in a plane extending transversely to said extrusion direction of said profile, has a first thickness; and wherein said apex area, when measured in said plane along said longitudinal dimension, has a thickness that is increased by at least about 20% above said first thickness of each of said legs.

8. The tweezer of claims 7, wherein each of said first and second legs has a bulge in which said first thickness of each of said legs is increased by at least about 30% above said first thickness of said legs so as to limit deformation of said legs upon manual compression.

9. The tweezer of claim 8, wherein each of said first and second legs, when viewed in a plane transverse to said longitudinal dimension of said tweezer, has an essentially prismatic cross-section, the height of which corresponds to said first thickness of said legs, and the width of which cross-section is at least twice as large as said first thickness.

10. The tweezer of claim 1, wherein each of said first and second legs, when viewed in a plane transverse to said longitudinal dimension of said tweezer, has a prismatic cross-section, the height of which corresponds to a first thickness of said legs, and the width of which cross-section is at least twice as large as said first thickness.

11. The tweezer of claim 10, wherein said prismatic cross-section is a rectangular cross-section.

12. The tweezers of claim 1, wherein the first and second legs are substantially straight.

13. The tweezers of claim 1, wherein the first and second legs contain no acute angles.

14. A method of producing a light-metal tweezer having a longitudinal dimension extending from a first end of said tweezer to a second end thereof, and comprising two legs, each having a first end and a second end, said two legs being interconnected at their first ends in an apex forming said first end of said tweezer; said legs being capable of reversible engagement with each other at their unconnected second ends by a manually exerted closure pressure; said method including the steps of:

providing a light-metal profile produced by extrusion in a direction of extrusion and having, when viewed in a plane transverse to said direction of extrusion, a cross-sectional shape at least approaching the shape of said tweezer when the latter is viewed in a plane extending through said legs and said apex; and dividing said profile by segmenting division approximately transversely to said direction of extrusion of said profile to form a plurality of tweezer-shaped elements.

15. A profile produced by extrusion of a metal, selected from the group consisting of light-metals and light-metal alloys, in a direction of extrusion; said profile when viewed in a plane transverse to said direction of extrusion has a cross-sectional shape at least approaching that of a monolithic tweezer having a first end and a second end and comprising two legs, each having a first end and a second end; said two legs being interconnected at their first ends in an apex forming said first end of said tweezer; said two legs being unconnected at their second ends forming said second end of said tweezer.

* * * * *